US005597075A

United States Patent [19]

Iwashige et al.

[11] Patent Number: 5,597,075

[45] Date of Patent: Jan. 28, 1997

[54] METHOD AND APPARATUS FOR SCREENING WASTE PAPER PULP

[75] Inventors: Naoyuki Iwashige; Masakazu Eguchi, both of Yokohama, Japan

[73] Assignees: Ishikawajima-Harima Jukogyo Kabushiki Kaisha; Ishikawajima Sangyo Kikai Kabushiki Kaisha, both of Tokyo-to, Japan

[21] Appl. No.: 546,022

[22] Filed: Oct. 20, 1995

Related U.S. Application Data

[62] Division of Ser. No. 317,362, Oct. 4, 1994.

[30] Foreign Application Priority Data

Oct. 20, 1993 [JP] Japan ..... 5-284225

[51] Int. Cl.[6] ..... B02B 1/00

[52] U.S. Cl. ..... 209/10; 209/273; 241/46.02

[58] Field of Search ..... 209/10, 268, 270, 209/273, 300, 305, 306; 241/61, 80, 81, 20, 21, 24, 46.02, 74; 162/4, 380, 234; 210/415, 413

[56] References Cited

U.S. PATENT DOCUMENTS 4,165,841 8/1979 Musselmann et al. .
4,267,035 5/1981 Martin ..... 209/273
4,699,324 10/1987 Ahs ..... 241/21
5,119,953 6/1992 Atkeison, III et al. ..... 209/273

FOREIGN PATENT DOCUMENTS 0273018 6/1988 European Pat. Off. .
2377475 8/1978 France .
1585309 2/1981 United Kingdom .

*Primary Examiner*—David H. Bollinger
*Attorney, Agent, or Firm*—Oblon, Spivak, McClelland, Maier & Neustadt, P.C.

[57] ABSTRACT

Waste paper stock pulp slurry supplied through a stock inlet is separated at screening sections to a high quality stock rejected stock containing contaminants and undefibered waste paper. The high quality stock is sent to a next stage as accepted stock. The rejected stock is sent to a defibering section and is diluted after defibration, part of the rejected stock; being circulated to the screening sections, the remainder being discharged out of the system through a rejection outlet. The provision of screening and defibering sections in one and the same screen can satisfy contradictory requirements, i.e., to increase contaminant removing efficiency, to raise production yield and to attain space and cost savings.

2 Claims, 10 Drawing Sheets

METHOD AND APPARATUS FOR SCREENING WASTE PAPER PULP

This is a division of application Ser. No. 08/317,362 filed on Oct. 4, 1994 and currently copending.

BACKGROUND OF THE INVENTION

1. Field of the Invention

The present invention relates to a method and an apparatus for separating contaminants from paper stock and defibering undefibered waste paper in the field of industries using waste paper pulp as stock such as paper pulp and fiberboard industries.

Screening is generally composed of coarse and fine screening stages.

2. Discussion of the Background

In the coarse screening stage, relatively large contaminants are removed, using a screen plate with holes usable for relatively high consistency (2 to 4%) of stock slurry in order to reduce in quantity the contaminants to be transferred to the fine screening stage.

In the fine screening stage, fine contaminants not removable by the above-mentioned hole screen plate are removed, using a screen plate with slots suitable for relatively low consistency (0.5 to 2%) of stock slurry so as to facilitate passing of the stock through the screen.

Generally, the efficiency or ratio of removing contaminants in a screen is closely related with the rejection ratio. Increase and decrease of the rejection ratio lead to enhancement and lowering of contaminant removal ratio, respectively. Attempts to reduce the rejection ratio in an ordinary screen will tend to cause plugging of the screen plate or plugging of a rejection valve due to increased rejection consistency. Even if such plugging may be averted, an extreme reduction of the rejection ratio would worsen the effect of removing contaminants as shown in FIG. 1, thus failing to obtain good screening effect. Increase of the rejection ratio to a certain extent is therefore required for obtaining pulp with less quantity of contaminants. However, increase of the rejection ratio means reduction of yield.

Generally, in order to overcome this problem in a screen stage, a rejection ratio of 20 to 25% is selected, over which the curve shown in FIG. 1 becomes dull and the contaminant removal ratio is less affected, and rejected stock is reprocessed by a so-called "multiple cascade flow" system to reduce the rejection ratio in the entire system. In a typical cascade flow employed, rejected stock of a primary screen is processed by a secondary screen and the accepted stock is brought to the primary screen. Rejected stock of the secondary screen are processed by a tertiary screen and the accepted stock is returned to the feed stock of the secondary screen. Only rejections of the tertiary screen are discharged out of the system. Generally, stock slurry consistency in a screen becomes higher than the consistency of the feed stock and therefore the feed stock used for the cascade flow is required to be diluted with water into an appropriate consistency for the screen.

On the other hand, paper stock to be fed to a screening stage is in the form of defibered suspension of waste paper in water by a defibrator, usually called a pulper. Defibering performance of the pulper is not in a linear relationship to defibration time period (motive power). In comparison with initial defibering performance, subsequent defibering performance is decreased. That is, defibering efficiency is satisfactory up to a certain level of defibration [i.e., defibered stock/(defibered stock+undefibered stock)] and higher motive power is required for defibration over the level. In order to defiber the stock which has been defibered to the certain level, a device generally called "secondary defibrator" is widely used. Typical secondary defibrators are a closed pulper type defibrator and a high-speed defibrator. Such secondary a defibrators also have defibering performance which is not in a linear relationship to motive power and are effective for use at a zone or portion of the system where undefibered waste paper is accumulated.

To defiber undefibered waste paper is very significant for improvement of production yield since the undefibered waste paper shows the same behavior as contaminants to be removed in screening stages.

In FIG. 2 which is a flow sheet of a conventionally used screening process for waste paper stock pulp slurry, reference symbol a represents a tank to receive waste paper stock slurry which has been defibered by a pulper (not shown). In a coarse screening stage A, reference symbols b, c and d represent primary, secondary and tertiary coarse screening screens, using hole screen plates, respectively; g represents a high-speed defibrator for defibering rejections of the primary coarse screening; and e, f and m denote tanks. In a fine screening stage B, reference symbols h, i, k, and l represent primary, secondary, tertiary and quaternary fine screenings, using slot screens, respectively; j indicates a high-speed defibrator for defibering rejections of the secondary fine screening screen; and n, o and p denote tanks. In FIG. 2, the solid lines represent pulp lines and dotted lines represent rejections including undefibered waste paper.

In FIG. 2, usual screens with hole screen plates are used in the coarse screening stage A. Rejections of the primary screen b is processed by the high-speed defibrator g to defiber undefibered waste paper accumulated in the reject. In the fine screening stage B, a quaternary cascade system with slot screens is used and the rejections of the secondary screen are processed by the high-speed defibrator j.

In FIG. 2, nine apparatuses with screens, seven tanks with agitators and seven pumps are required. For automatic operation, various instruments are further required such as pressure control for each screen and level control for each tank.

Instead of defibering waste paper, the waste paper may be ground by a refiner. Such grinding is, however, directed to crushing not only the undefibered waste paper but also contaminants such as plastics and is different from the defibration in which contaminants such as plastics and wooden pieces are passed without crushing, and therefore has a deteriorated degree of screening compared with the defibration. Also, the stock slurry consistency in the grinding is as high as 15 to 25% while in the defibration, the stock must be diluted to have the consistency of 1 to 4% because of the above difference.

As described above, the more the number of screens for cascade is increased, the more the degree of screening and production yield can be enhanced, but the scale and cost of the facilities are corresponding increased.

To solve the above problems, there have been various proposals to provide a system in which a screening section is combined with a defibering section or with a grinding section.

For example, Japanese Patent 1st Publication No. 62-90391 (JP-A-62-90391) proposes "a screening apparatus with rejection reducing means" which processes pulps with vegetable fiber of 6 to 15% in consistency. A grinding zone is provided adjacent to a screen with a cylindrical screen plate and the reject is decreased in quantity by grinding the rejected stock of the screen into pulpiness. However, when this apparatus is used for waste paper pulp, there arise the following problems:

(1) Unlike vegetable fiber pulp, waste paper pulp includes not only the undefibered waster paper but also contaminants such as plastics and metal pieces. If these contaminants are ground and mingled with the accepted stock, the product quality is decreased.

(2) A consistency suitable for the grinding is 15 to 25%. In the case of waste paper pulp, if the rejected stock of the screen is condensed to this range of consistency, plugging tends to occur in the screen. If the meshes of the screen are enlarged for prevention of such plugging, then the contaminant removal ratio is reduced.

(3) After the grinding, contaminants remain in the pulp. To remove them, another screen is required.

On the other hand, the inventors have made various experiments to find that, when waste paper pulp slurry is screened, rejected stock not passing through a screen are accumulated more and more and its consistency is increased as the slurry flows through a screening section, deteriorating the separation effect, and that the separation effect may be improved if such condensed reject is diluted in the screen.

SUMMARY OF THE INVENTION

To solve the above problems, it is an object of the present invention to provide a method and apparatus for screening waste paper in which a single screen has screening and defibering sections and reject after the defibration is diluted and re-separated, thereby increasing contaminant removal ratio and production yield and achieving space- and cost-saving and simple system control.

To attain the above object, an apparatus according to a first aspect of the present invention comprises a cylindrical casing having a stock inlet at one end thereof, a rejected stock outlet at the other end thereof and an accepted stock outlet between the ends thereof, a cylindrical screen plate concentrically fixed to define a space between an inner surface of said casing and said screen plate, an annular defibration stator concentrically disposed adjacent to an end of said screen plate near said reject outlet, a rotor rotated around an axis of said casing, said casing partitioned into an inlet chamber communicated with said stock inlet and with a space inside said screen plate an accepted chamber outside said screen plate and communicated with said accepted stock outlet and a rejection chamber communicated with said rejection outlet, said rotor having scraper blades faced to said screen plate for preventing plugging of the screen, a defibration rotor faced to said defibration stator and a dilution chamber opened to said reject chamber, dilution openings extending through a peripheral wall of said dilution chamber and spaced apart from each other in a circumferential direction so as to pass dilution water toward said screen plate between axial ends of said screen plate, facing surfaces of said defibration stator and said defibration rotor being divergent toward said reject chamber, and a dilution water nozzle in said casing adjacent to said dilution chamber for feeding dilution water to said dilution chamber.

An apparatus according to a second aspect of the present invention comprises a cylindrical casing having a stock inlet at one end thereof, a rejected stock outlet at the other end thereof and a plurality of accepted stock outlets between the ends thereof, cylindrical front and rear screen plates concentrically fixed to define a space between an inner surface of said casing and said screen plates, an annular defibration stator concentrically disposed between said front and rear screen plates, a rotor rotatable around an axis of said casing, said casing partitioned into an inlet chamber communicated with said stock inlet and with a space inside said front screen plate, accepted stock chambers disposed outside said screen plates and communicated with said accepted stock outlets and a rejection chamber communicated with said rejection outlet, said rotor having scraper blades faced to said screen plates for preventing plugging of the screen, a defibration rotor facing to said defibration stator and a dilution chamber opened to said rejection chamber, dilution openings extending through a peripheral wall of said dilution chamber and spaced apart from each other in a circumferential direction so as to pass dilution water toward said screen plates and a dilution water nozzle in said casing for feeding dilution water to said dilution chamber.

In the first aspect of the present invention, waste paper stock pulp slurry containing undefibered waste paper is introduced into the screen to separate the slurry into a high quality stock passing through the screen plate and rejected stock not passing through the screen plate. Said high quality stock is sent to a next stage as accepted. Said rejected stock is passed through the gap of the defibrator comprising said defibration stator and said defibration rotor adjacent to said screen plate so that undefibered waste paper in said rejected stock is defibered and the rejected stock is subjected to is increased pressure and is discharged into the rejection chamber where it is diluted with dilution water and circulated through the dilution chamber to said screen, the rejected stock being partly discharged out of the system.

In the second aspect of the present invention, waste paper stock pulp slurry containing undefibered waste paper is introduced into a front screening section to separate the slurry into a high quality stock passing through the front screen plate and a rejected stock not passing through the front screen plate. Said high quality stock is sent to a next stage as accepted stock. Said rejected stock is passed through the gap of the defibrator comprising said defibration stator and said defibration rotor adjacent to said front screen plate so that undefibered waste paper in said rejected stock is defibered. The slurry thus processed for defibration is sent to the rear screening section disposed adjacent to said defibrator and is separated into a high quality stock passing through the rear screen plate and a rejected stock not passing through the rear screen plate. Said high quality stock is sent to a next stage as accepted stock. Said rejected stock is discharged out of the system through the rejection outlet. Dilution water is supplied to the front and rear screening sections through the rotor.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DESCRIPTION OF THE PREFERRED EMBODIMENTS

FIGS. 3 to 6Y shows an apparatus for screening waste paper pulp according to a first embodiment of the present invention.

Figure 3:
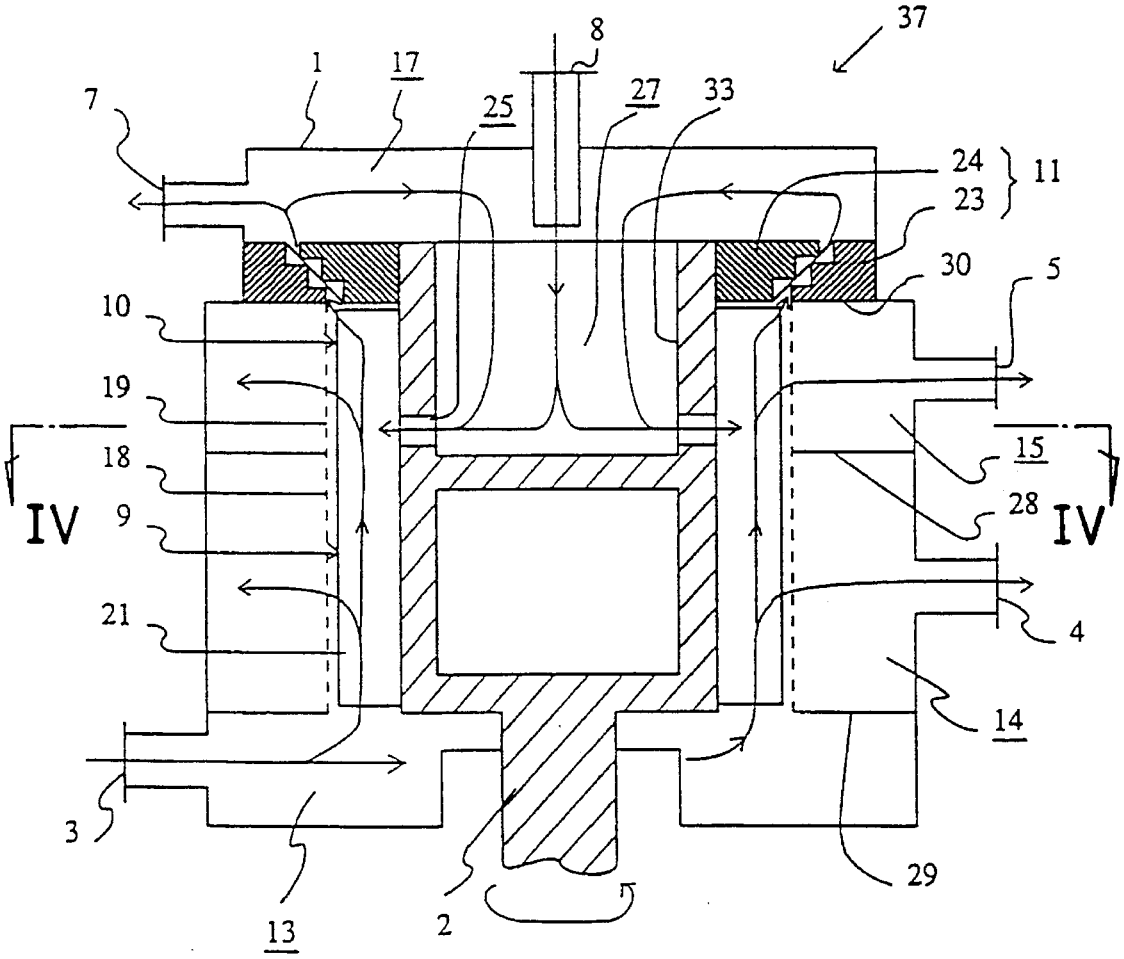
FIG. 3 is a front view in section of an apparatus for screening waste paper pulp according to a first embodiment of the present invention.

In FIG. 3, which is a front view in section of the apparatus, arrows indicate flows of stock and dilution water. Reference numeral 1 represents a generally cylindrical casing with a stock inlet 3 at its lower end, a rejection outlet 7 at its upper end and accepted stock outlets 4 and 5 between the ends of the casing 1.

The casing 1 has primary and secondary cylindrical screen plates 18 and 19 concentrically fixed in the casing 1 to define primary and secondary accept stock chambers 14 and 15 between an inner surface of the casing 1 and the plates 18 and 19. The casing 1 further has an annular defibration stator 23 concentrically disposed in the casing 1 adjacent to and above the secondary screen plate 19 as well as a rotor 2 rotated by a drive unit (not shown) around an axis of the casing 1.

The casing 1 has at its lower inner end an inlet chamber 13 which is communicated with the stock inlet 3 and with a space inside the screen plates 18 and 19. Primary and secondary accepted stock chambers 14 and 15 are formed outside the screen plates 18 and 19 between these plates 18 and 19 and an inner surface of the casing 1 and respectively partitioned by annular partitions 28 and 29, and 28 and 30. The casing 1 further has at its upper inner end a rejected stock chamber 17 which is communicated with the rejection outlet 7.

Figure 4:
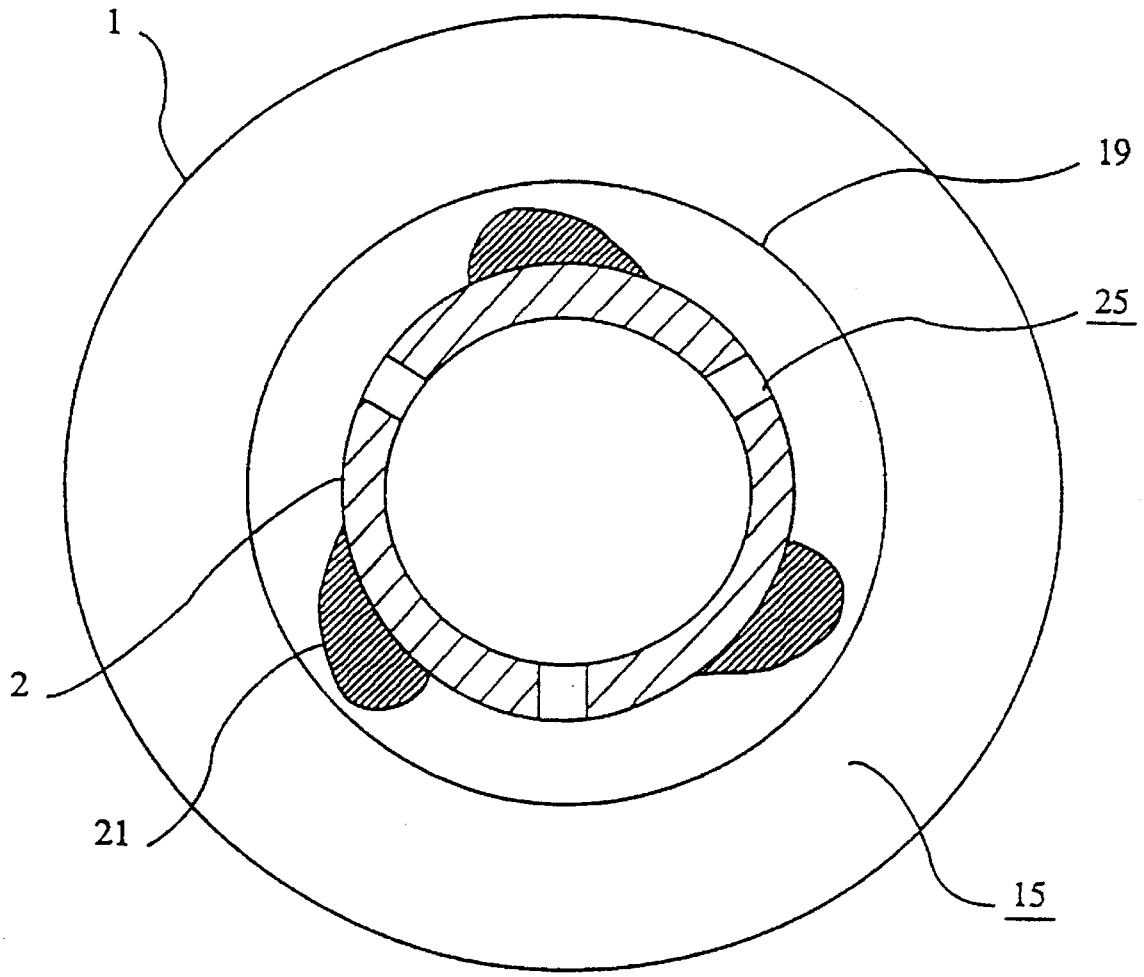
FIG. 4 is a view looking in the direction of arrows IV—IV in FIG. 3.

The rotor 2 has at its outer periphery scraper blades 21 facing to the screen plates 18 and 19. The scraper blades 21 is of a substantially circular arcuate section as shown in FIG. 4, the number of the blades 21 being usually two to eight depending upon the size of the screen. A gap between the scraper blades 21 and the screen plates 18 and 19 is 0.5 to 15 mm. When the blades are rotated at high speed of 10 to 25 m/s inside the screen plates 18 and 19, a mat of pulp accumulated on the inner surfaces of the screen plates 18 and 19 is destroyed by negative pressure generated on a rear side in a rotating direction, thereby preventing plugging of the screen plates 18 and 19. The scraper blades 21 and the screen plates 18 and 19 provide primary and secondary screen portions 9 and 10.

Figure 5A:
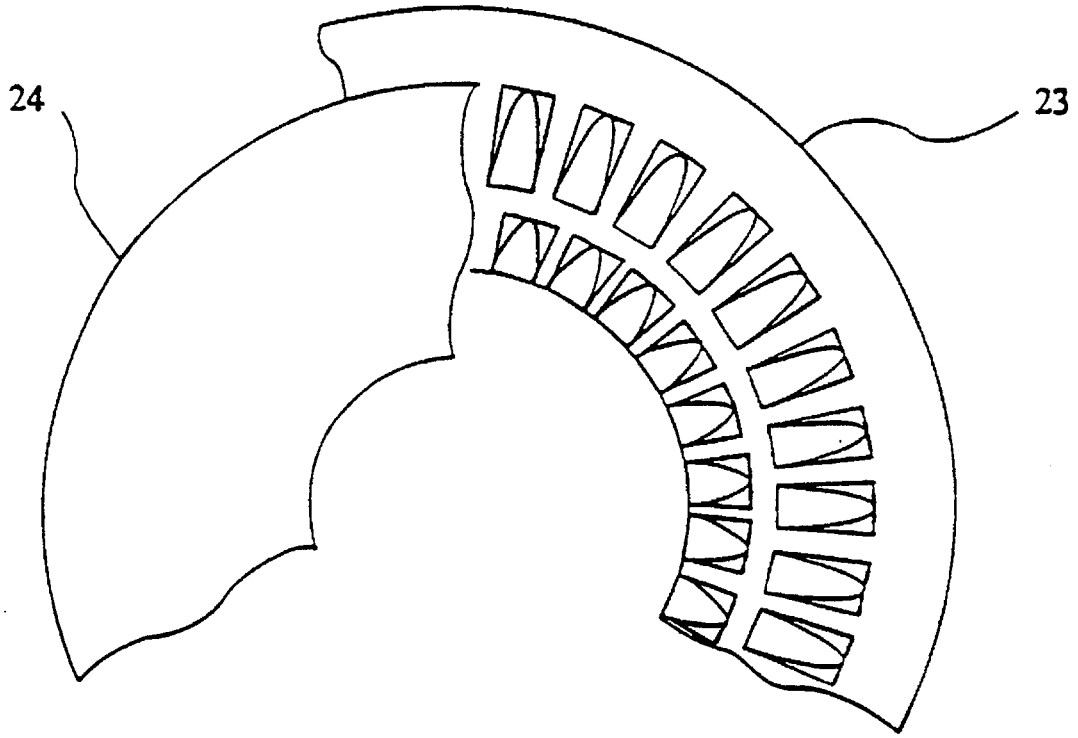
FIG. 5X is a plan view of a defibering section of the first embodiment.
FIG. 5Y is a sectional view of the defibering section shown in FIG. 5X.
Figure 5B:
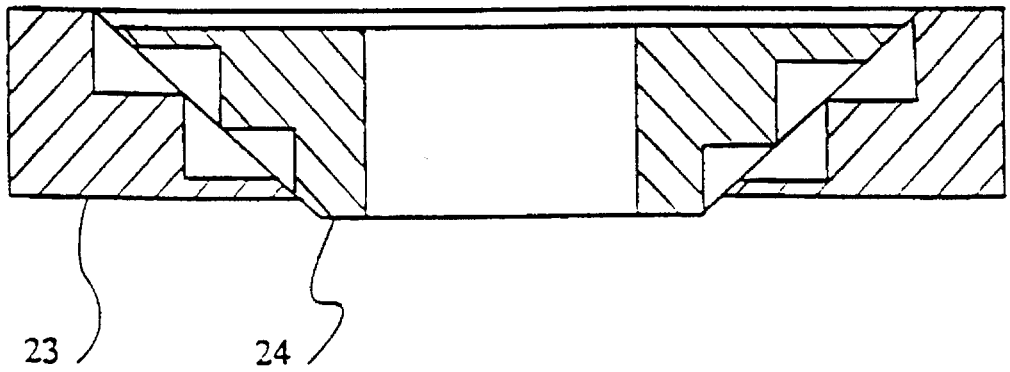

The rotor 2 has at its upper end a defibration rotor 24 disposed adjacent to the scraper blades 21. The rotor 24 and the stator 23 which is fixed to the casing 1 provide a defibering section 11 which may be designed as shown in FIGS. 5X and 5Y or as disclosed in Japanese Patent 2nd Publication No. 57-60475 (JP-B-57-60475). As shown in FIGS. 5X and 5Y, frustoconical operating surfaces of the stator 23 and rotor 24 diverged toward the reject chamber 17 are faced towards each other with a slight gap and have a number of pockets formed circumferentially and in two steps in a direction of a generating line. The two steps of pockets, i.e., the smaller- and larger-diameter pockets serve as inlet and outlet, respectively. When waste paper stock pulp slurry passes the operating surfaces and the pockets, undefibered waste paper is defibered by fluid shearing action caused by agitated turbulence while the contaminants such as plastics pass through without being pulverized. Further, the defibering section 11, whose outlet is of larger diameter than its inlet, serves for pressure increase.

The rotor 2 has at its upper portion a cylindrical dilution chamber 27 which is opened upwardly and is communicated with the rejection chamber 17. The dilution chamber 27 has a peripheral wall 33 through which dilution openings 25 extend and are directed toward a lower portion of the secondary screen plate 19. The number of the dilution openings 25 is usually two to eight depending upon the size of the screen.

The casing 1 has at its top a dilution water nozzle 8 which in turn is opened at its lower end adjacent to the dilution chamber 27 of the rotor 2.

Figure 6A:
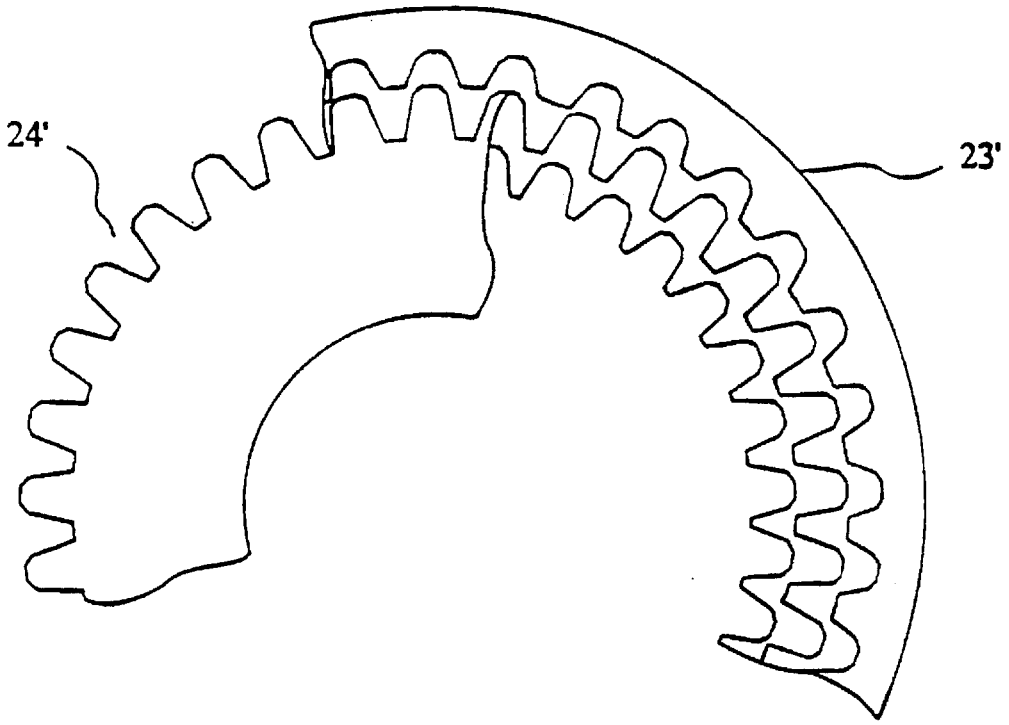
FIG. 6X is a plan view of a variation of the defibering section.
FIG. 6Y is a sectional view of the defibering section shown in FIG. 6X.
Figure 6B:
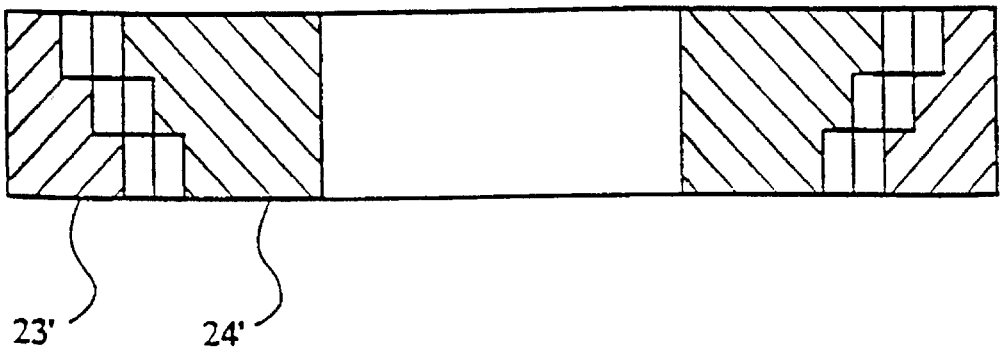

The shape of the defibering section 11 is not limited to that shown in FIGS. 5X and 5Y and may be as shown in FIGS. 6X and 6Y. In FIGS. 6X and 6Y, an inner periphery of the stator 23' and an outer periphery of the rotor 24' which is rotated with a small gap from the stator 23' respectively have steps with increased diameters toward the flowing direction of stock, the respective steps having a tooth shape similar to spur gear. The partition 28 may be omitted to have a single accepted chamber; in this case, a single accept stock outlet is provided.

Next, referring to FIG. 3, the mode of operation of the apparatus for screening waste paper pulp according to the first embodiment of the invention will be described.

The waste paper stock pulp slurry containing undefibered waste paper is introduced through the stock inlet 3 into the inlet chamber 13 and is sent to the primary screening section 9 inside the primary screen plate 18 so that a high quality stock passes through the plate 18 into the primary accept stock chamber 14 and is sent to a next stage through the primary accept stock outlet 4. The waste paper pulp slurry which did not pass through the plate 18 in the primary screening section 9 is sent to a secondary screening section 10, is diluted with dilution water supplied through the dilution openings 25 of the rotor 2 and undergoes screening. High quality stock passes through a secondary screen plate 19 into the secondary accepted stock chamber 15 and is sent to a next stage through the secondary accepted stock outlet 5.

The rejected stock which did not pass through the screen plate 19 at the secondary screening section 10 includes contaminants such as plastics to be removed and undefibered waste paper which are accumulated, and is sent to the defibering section 11 where the undefibered waste paper is defibered by the action of agitated turbulence and at the same time, pressure is increased by pumping action of the defibering section 11. In this case, contaminants such as plastics are not pulverized to finer size and pass through the defibering section 11. After passing through the defibering section 11, the rejected stock flows into the rejection chamber 17 as waste paper stock pulp slurry containing newly defibered and withdrawable fibers. In the rejection chamber 17, the slurry is mixed with dilution water coming through the dilution water nozzle 8. The diluted waste paper stock pulp slurry passes through the dilution chamber 27 of the rotor 2 and circulates through the dilution openings 25 into the secondary screening section 10 where the fibers newly defibered at the defibering section 11 are collected. The waste paper pulp slurry in the rejection chamber 17, which includes accumulated contaminants such as plastics, is partly discharged out of the system and is dumped.

Next, referring to FIGS. 7, 8X an 8Y, the apparatus for screening waste paper pulp according to the second embodiment of the present invention will be described.

Figure 7:
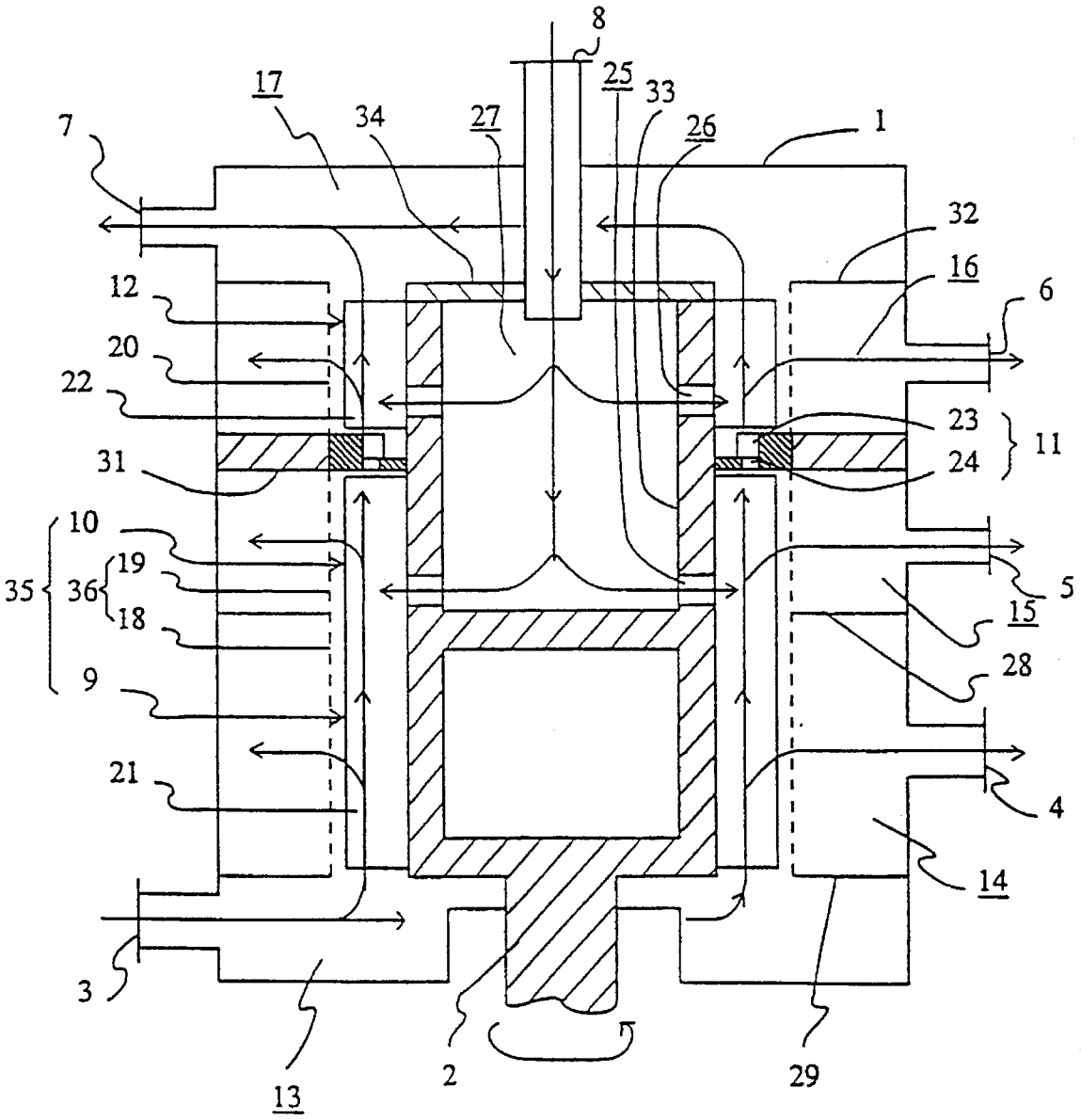
FIG. 7 is a front view in section of an apparatus for screening waste paper pulp according to a second embodiment of the present invention.
Figure 8A:
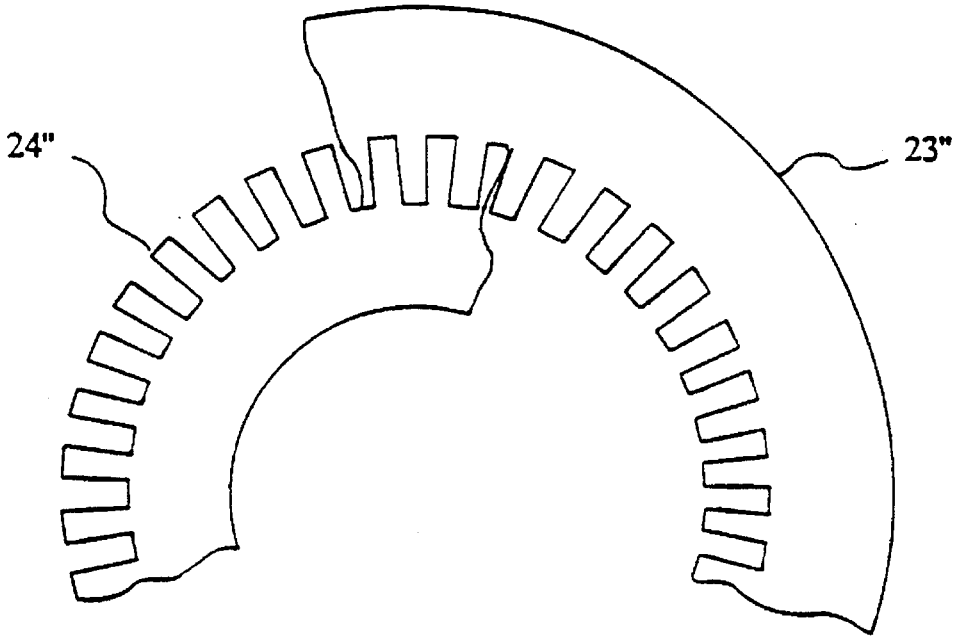
FIG. 8X is a plan view of a defibering section of the second embodiment.
FIG. 8Y is a sectional view of the defibering section shown in FIG. 8X.
Figure 8B:
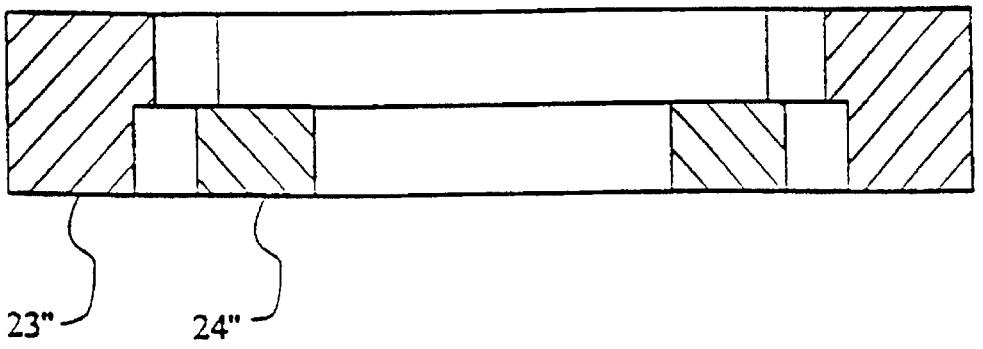

The apparatus of the second embodiment shown in FIG. 7, which is a front view in section of the apparatus, is substantially similar to the apparatus of the first embodiment shown in FIG. 3. The same component are referred by the same reference numerals and a description thereof therefore is omitted. Added components specific for the second embodiment will be described. In this connection, the primary and secondary screening sections 9 and 10 in FIG. 3 are put together and are referred to as front screening section 35. The primary and secondary screen plates 18 and 19 in FIG. 3 are put together and are referred to as front screen plate 36.

The casing 1 has therein a rear screen plate 20 which is coaxial with the casing 1 and disposed adjacent to and above a defibration stator 23. A rear accepted stock chamber 16 is defined by the rear screen plate 20 and the inner wall of the casing 1 and partitioned by annular partitions 31 and 32. The rear accepted stock chamber 16 has a rear accepted stock outlet 6.

The rotor 2 has at its outer periphery rear scraper blades 22 adjacent to and above the defibration rotor 24. The rear screen plate 20 and the rear scraper blades 22 provide a rear screening section 12.

The rotor 2 has the dilution chamber 27 with the peripheral wall 33. Through the wall 33, not only the dilution openings 25 extend toward the lower portion of the secondary screen plate 19 in the front screening section 35 but also dilution openings 26 extend toward the rear screen plate 20.

The dilution chamber 27 of the rotor 2 is closed at its top by a lid 34 so as to surround a lower end of the dilution water nozzle 8. This lid 34 may be omitted.

In this second embodiment, there is no need of increasing pressure in the defibering section 11. Therefore, the defibering section 11 may not have steps with the increased diameters upwardly as shown in FIGS. 5X and 5Y or 6X and 6Y and may be designed as shown in FIGS. 8X and 8Y where a defibration screen 23" with inwardly directed comb-like teeth is engaged with a defibration rotor 24" with outwardly directed comb-like teeth such that their teeth are vertically aligned.

Next, referring to FIG. 7, the mode of operation of the a screening apparatus for waste paper pulp according to the second embodiment will be described.

Since this apparatus is substantially similar to that of the first embodiment shown in FIG. 3 except that a rear screening section 12 is added, description will be given with respect to the added components, rather than the common components.

The rejected stock, which has passed through the defibering section 11, is in the form of waste paper stock pulp slurry and contains fibers which are newly defibered and can be withdrawn for utilization. The rejected stock enters into the rear screening section 12 and is diluted with dilution water supplied through the dilution openings 26 of the rotor 6 and undergoes screening. High quality stock, which has passed through the rear screen plate 20, flows into the rear accepted stock chamber 16, is discharged through the rear accepted stock outlet 6 and is sent to a next stage.

In the apparatus shown in FIG. 7, the high quality stock defibered in the defibering section 11 is withdrawn at the rear screening section 12 so that there is no need of circulating the rejected stock of the rear screening section 12 to the screening sections 35 and 12. For this reason, the lid 34 is provided for separation of the dilution water from the screened rejected stock. The lid 34 may be omitted so that the screened rejected stock can be further circulated to the screening sections 35 and 12.

Next, a description will be given as to operation of an apparatus for screening waste paper pulp according to the first or second embodiment of the present invention to a screen stage or stages.

Figure 9:
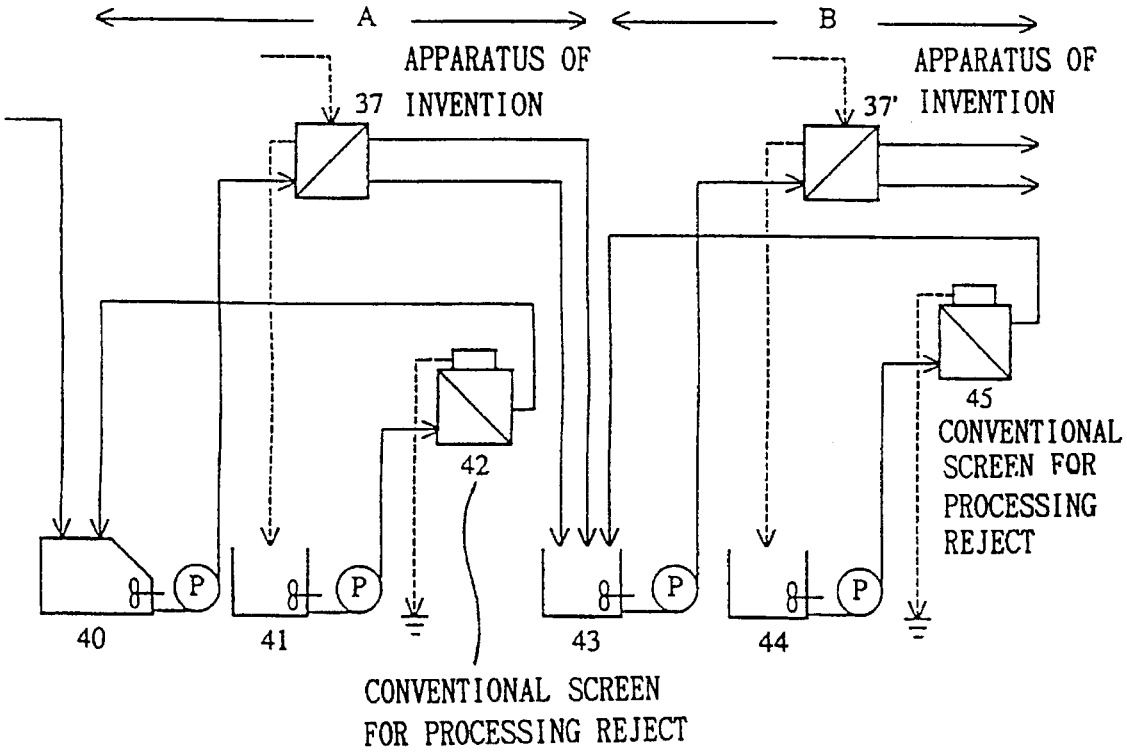
FIG. 9 is a flow sheet of a screening process based on the present invention.

FIG. 9 is a flow sheet of a process in which the apparatuses for screening waste paper pulp of the present invention are used in the coarse and fine screening stages A and B. In FIG. 9, reference numerals 37 and 37' represent apparatuses for screening waste paper pulp according to the present invention. The apparatus 37 uses a hole screen plate since it is for the coarse screening stage. The apparatus 37' uses a slot screen plate since it is for the fine screening stage.

In FIG. 9, reference numerals 40, 41, 43 and 44 represent tanks; and 42 and 45, conventional screens for processing the reject.

Figure 1:
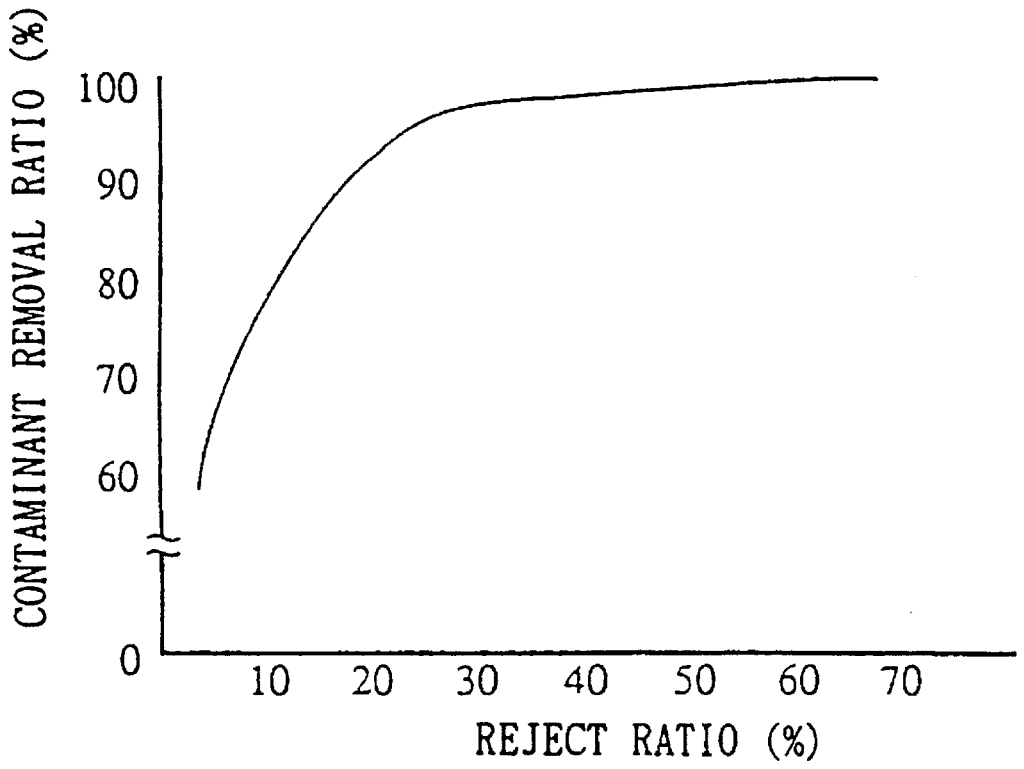
FIG. 1 PRIOR ART
FIG. 1 is a diagram showing a relationship between the rejection ratio and contaminant removal ratio in a conventional screen.
Figure 2:
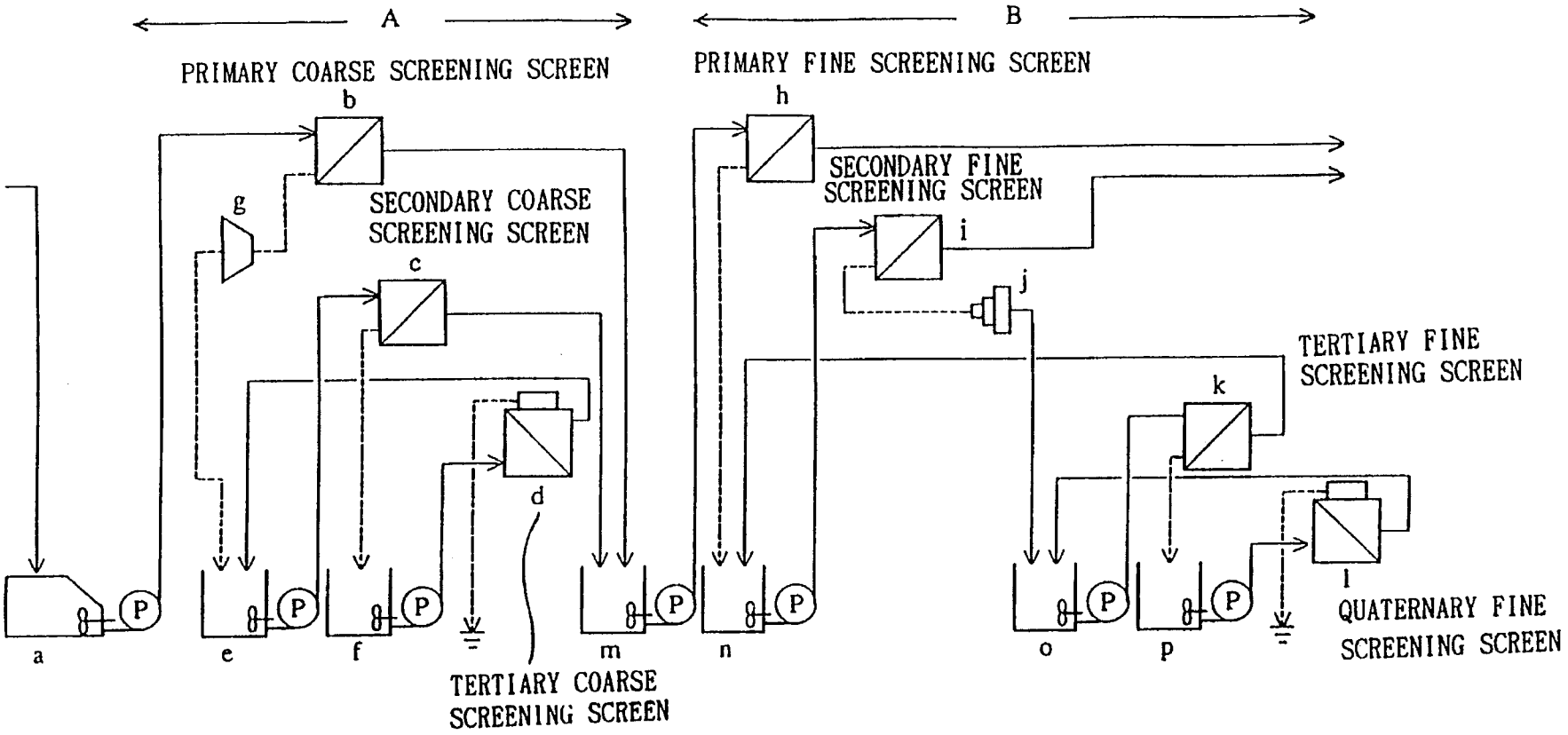
FIG. 2 PRIOR ART
FIG. 2 is a flow sheet of a conventional screening process.

In comparison of FIG. 9 with FIG. 2, it is evident that the number of screening apparatuses and tanks is extensively decreased.

Figure 10:
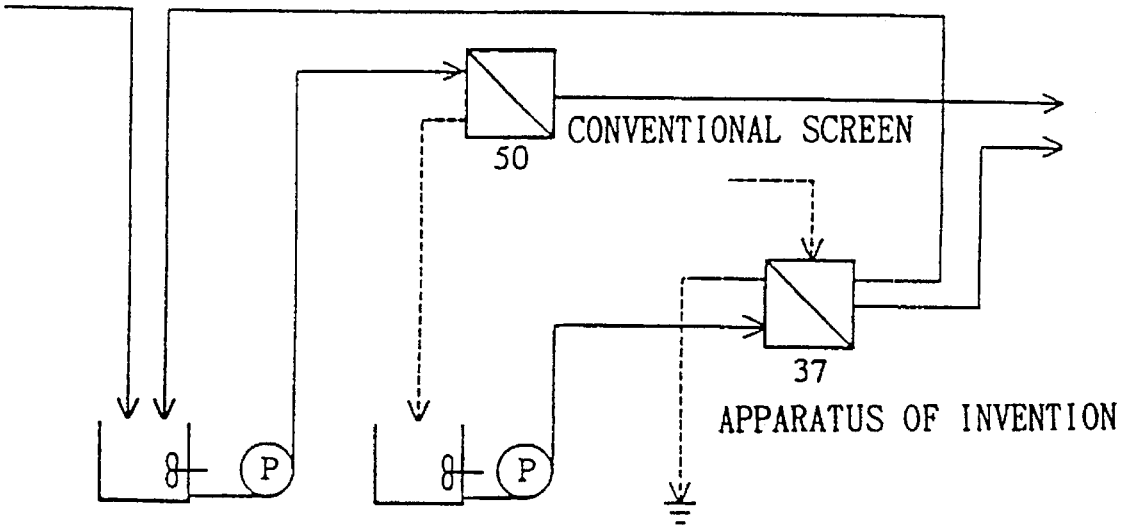
FIG. 10 is a flow sheet of a screening process in which the present invention is applied for processing the reject.

FIG. 10 shows a case in which the apparatus according to the present invention is used for processing the rejected stock in a conventional type system. Reference numeral 50 represents a conventional screen.

Table 1 shows experimental data when the apparatus for screening waste paper pulp according to the first embodiment (FIG. 3) was used for actual screening of waste paper stock pulp slurry.

TABLE 1

| | | Conventional Screen | Invention |
|---|---|---|---|
| Processed quantity (T/D) | Stock inlet | 30 | 30 |
| | Primary accept stock outlet | 22.5 | 22.5 |
| | Secondary accept stock outlet | — | 6 |
| | Rejected stock outlet | 7.5 | 1.5 |
| Rejection ratio (%) | | 25 | 5 |
| Content of undefibered substances (%) | Stock inlet | 11 | 11 |
| | Primary accept stock outlet | 2 | 2 |
| | Secondary accept stock outlet | — | 2 |
| | Rejected stock outlet | 30 | 38 |
| Content of undefibered substances (T/D) | Stock inlet | 3.3 | 3.3 |
| | Primary accept stock outlet | 0.45 | 0.45 |
| | Secondary accept stock outlet | — | 0.1 |
| | Rejected stock outlet | 2.25 | 0.57 |
| Reduction ratio of undefibered substances (%) | | 18 | 66 |

In this experiment, waste paper stock from cardboard with stock consistency of 1.8% was used to compare performance characteristics of a conventional screen with those of the apparatus for screening waste paper according to the present invention (the apparatus shown in FIG. 3). Screen plates employed were slot screen plates of 0.25 mm in width.

In Table 1, processed quantity (T/D) represents dry weight of stock: the rejection ratio (%), ratio of total dry weight of rejected stock to total dry weight of stock at inlet; content of undefibered substances (%), dry weight of undefibered substances per unit dry weight of processed stock; content of undefibered substances (T/D), total dry weight of undefibered substances in the processed stock; and reduction ratio of undefibered substances (%), reduction ratio of total dry weight of undefibered substances after passing through the screening apparatus. The quantity of the undefibered substances was somewhat decreased in the conventional screen, which means that more or less defibration has occurred in the screen.

As is evident from the above test results, the rejection ratio is 1/5 of that of the conventional screen whereas the quantity of undefibered substances in the accept stock was about the same as that of the conventional screen.

In the apparatus for screening waste paper pump according to the present invention, screened rejection is defibered with the defibering section 11 in the screen and dilution water is supplied to the secondary screening section 10 to perform screening at adequate consistency. Further, the rejected stock may be circulated. As a result, it is possible to reduce the quantity of the rejected stock, which flows out through the rejection outlet 7 even when the rejected stock is more than 20% at the primary and secondary screening sections 9 and 10. This makes it possible to satisfy two contradictory requirements, i.e. to obtain good screening effect without plugging and to reduce total reject quantity.

It is to be understood that the method and the apparatus for screening waste paper pulp according to the present invention are not limited to the above-mentioned embodiments and that various modifications may be made without departing from the spirit of the present invention.

As is clear from the foregoing, features and advantages of the method and the apparatus for screening waste paper pulp according to the present invention may be summarized as follows:

(1) Screening and defibering effects are attained in a single screen, which enables simplification of screening stages as well as substantial reduction of installation and running costs.

(2) Dilution is performed in the course of screening, which improves screening effect in the downstream side in the screening and leads to increase of overall production yield.

(3) High quality stock defibered in the defibering section is withdrawn, so that the reject ratio can be substantially reduced.

Obviously, numerous modifications and variations of the present invention are possible in light of the above teachings. It is therefore to be understood that within the scope of the appended claims, the invention may be practiced otherwise than as specifically described herein.

What is claimed:

1. A method for screening waste paper pulp, comprising;

introducing waste paper stock pulp slurry containing undefibered waste paper into a screening section, separating the slurry into a high quality stock passing through a screen plate and a rejected stock not passing through said screen plate, said high quality stock being sent to a next state as accepted stock, and;

passing said rejected stock through a gap in a defibering section which is adjacent to said screen plate and which comprises a defibration stator and a defibration rotor, such that undefibered waste paper contained in the rejected stock is defibered and the rejected stock is subjected to increased pressure, the rejected stock is discharged to a rejection chamber, the rejected stock is diluted with dilution water, and the diluted rejected stock is circulated through a dilution chamber to the screening section while part of said rejected stock is discharged out of the system.

2. A method for screening waste paper pulp, comprising:

introducing waste paper stock pulp slurry containing undefibered waste paper into a front screening section, separating the slurry into a high quality stock passing through a front screen plate and a rejected stock not passing through said front screen plate, said high quality stock being sent to a next stage as accepted stock, passing said rejected stock through a gap in a defibering section which is adjacent to said front screen plate and comprises a defibration stator and a defibration rotor, such that undefibered waste paper contained in the reject is defibered, the slurry thus defibered is sent to a rear screening section adjacent to said defibering section, separating the slurry into a high quality stock passing through a rear screen plate and a rejected stock not passing through said rear screen plate, said high quality stock being sent to the next stage as accepted stock, and discharging said rejected stock out of the system through a rejection outlet, said front and rear screening sections being supplied with dilution water through a rotor.

* * * * *

UNITED STATES PATENT AND TRADEMARK OFFICE

CERTIFICATE OF CORRECTION

PATENT NO. : 5,597,075

DATED : January 28, 1997

INVENTOR(S) : IWASHIGE ET AL

It is certified that error appears in the above-indentified patent and that said Letters Patent is hereby corrected as shown below:

Column 5, line 15, change "5X" to --5A--;
line 17, change "5Y" to --5B--;
line 19, change "6X" to --6A--;
line 21, change "6Y" to --6B--;
line 22, change "6X" to --6A--;
line 26, change "8X" to --8A--;
line 28, change "8Y" to -8B--;
line 29, change "8X" to --8A--.

Column 6, line 21, change "5X" to --5A--; same line, change "5Y" to --5B--;
line 23, change "5X" to --5A--; same line, change "5Y" to --5B--;
line 48, change "5X" to --5A--; same line, change "5Y" to --5B--;
line 49, change "6X" to --6A--(both occurrences); same line, change "6Y" to --6B--(both occurrences).

Column 7, line 30, change "8X an 8Y" to --8A and 8B--.

UNITED STATES PATENT AND TRADEMARK OFFICE

CERTIFICATE OF CORRECTION

PATENT NO. : 5,597,075
DATED : January 28, 1997
INVENTOR(S) : Iwashige, et. al.

It is certified that error appears in the above-indentified patent and that said Letters Patent is hereby corrected as shown below:

Column 8, line 2, change "5X" to --5A--, same line, change "5Y to --5B--; still same line, change "6X" to --6A--; line 3, change "6Y" to --6B--.

Signed and Sealed this

First Day of July, 1997

Bruce Lehman

*Attest:*

BRUCE LEHMAN

*Attesting Officer*

*Commissioner of Patents and Trademarks*